United States Patent [19]

Barbeau

[11] 4,232,526

[45] Nov. 11, 1980

[54] HIGH INTENSITY SLINGER TYPE COMBUSTOR FOR TURBINE ENGINES

[75] Inventor: Dennis E. Barbeau, Liberty Center, Ohio

[73] Assignee: Teledyne Industries, Inc., Los Angeles, Calif.

[21] Appl. No.: 972,678

[22] Filed: Dec. 26, 1978

[51] Int. Cl.[3] ..... F02C 7/22

[52] U.S. Cl. ..... 60/745

[58] Field of Search ..... 60/39.74 S; 431/168, 431/169

[56] References Cited

U.S. PATENT DOCUMENTS

| | | | |
|---|---|---|---|
| 3,932,988 | 1/1976 | Beaufrere | 60/39.74 S |
| 3,983,694 | 10/1976 | Bracken | 60/39.74 S |
| 4,040,251 | 8/1977 | Heitmann et al. | 60/39.74 S |

*Primary Examiner*—Robert E. Garrett

*Attorney, Agent, or Firm*—Gifford, VanOphem, Sheridan & Sprinkle

[57] ABSTRACT

A rotating slinger fuel injector for turbine engines is provided with a plurality of radial holes for distributing and mixing fuel and air throughout the combustor. Fuel is supplied from a stationary fuel manifold through fuel ports in a rotating slinger which distributes the fuel in a plurality of planes throughout the combustor. Air is channeled from the compressor rotor through radially and axially angled air ports provided in the slinger so as to distribute air in a plurality of planes which intersect the planes of distributed fuel at various points throughout the interior combustor. Thus the combustion intensity and efficiency is greatly increased.

6 Claims, 5 Drawing Figures

Fig-1
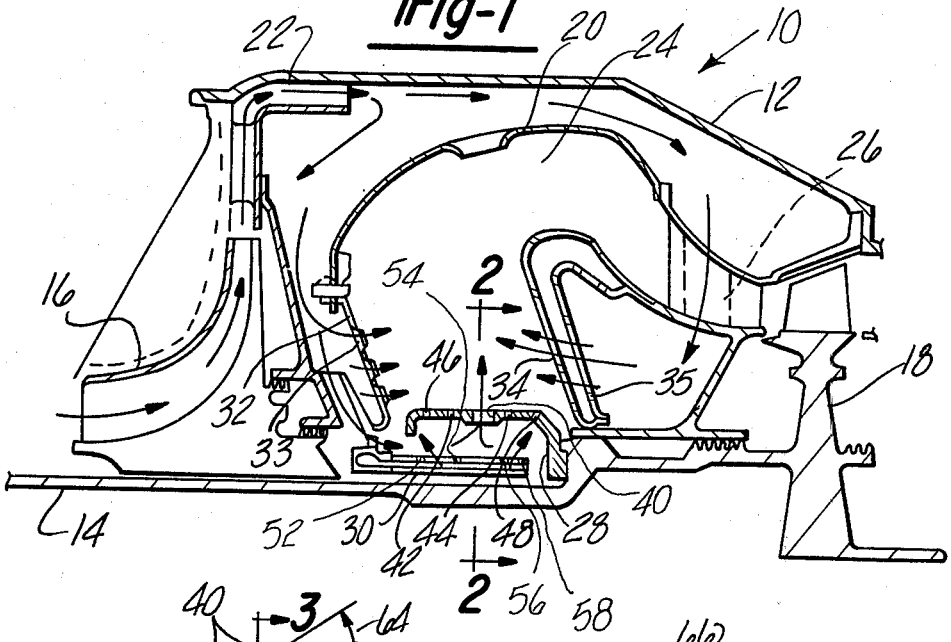
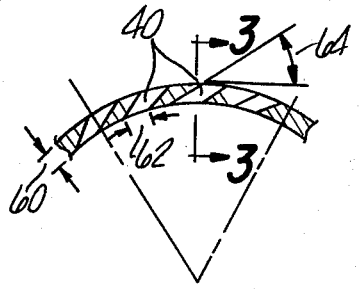
Fig-2
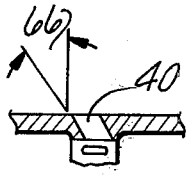
Fig-3
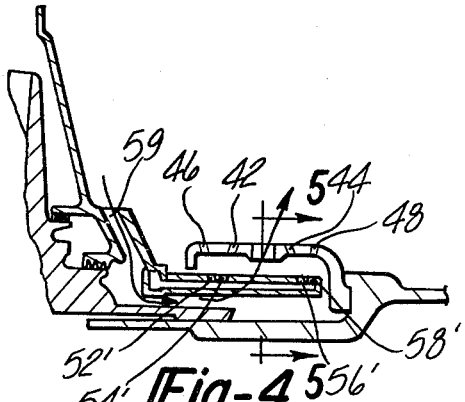
Fig-4
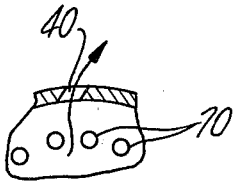
Fig-5

HIGH INTENSITY SLINGER TYPE COMBUSTOR FOR TURBINE ENGINES

BACKGROUND OF THE INVENTION

I. Field of the Invention

The invention relates generally to turbine engines and more specifically to turbine engines utilizing a slinger type fuel injector.

II. Description of the Prior Art

In order to introduce fuel into the combustion chamber of a turbine engine, it has been found advantageous to utilize a rotating slinger fuel injector. Previously known slinger injectors comprise an annular housing having radial apertures therethrough which is coaxially secured to the shaft of a turbine engine. The slinger is disposed between a stationary fuel manifold and the combustion chamber so that as the slinger is rotated, the fuel is centrifugally forced from the fuel manifold radially outwardly from the housing into the combustion chamber. The combustion chamber housing is generally provided with a plurality of air passages which direct air channeled from the compressor of the turbine into the combustion chamber to mix with the fuel provided by the slinger injector.

Previously known slinger injectors introduce fuel into the combustion chamber in a single axial plane. Air was introduced ahead of and behind this zone. Consequently, depending upon the position of the air passages in the combustion chamber housing, fuel is mixed with air only in certain portions of the combustor chamber. Thus the concentration of fuel and air is limited to a single plane within the combustor.

In order to minimize the volume and weight of a turbine engine, it is necessary to maximize the combustor loading, i.e., minimize the volume of the combustor chamber required for a given heat release rate.

By increasing the area over which the fuel is introduced into the combustor primary zone, i.e., area available for the fuel and air to mix and burn, combustion volume can be reduced, or efficiency of combustion can be increased for a given volume under certain environmental conditions, i.e., starting and high altitude operation.

Such improvement has been effectively accomplished in vaporizer combustors by significantly increasing the number of vaporizer tubes and thus, the number of points of fuel introduction. However, such methodology has not yet been applied to slinger type injectors because of the difficulty in increasing the effective area of air and fuel introductions at the slinger injector face.

To provide the optimum concentrations of fuel and air throughout the entire volume of the combustor chamber it would be advantageous to provide a plurality of planes of fluid flow from the slinger face which intersect with planes of air introduction at a plurality of locations throughout the entire volume of the combustor.

SUMMARY OF THE PRESENT INVENTION

The present invention provides increases in the combustion intensity or heat release per volume by providing a slinger fuel injector having a first set of radial bores which introduce fuel into the combustor chamber and a second set of radial bores through which air from the compressor of the turbine engine is introduced into the combustor chamber. Each set of radial bores is aligned in a plurality of axially spaced apart rows of radial bores. Rows of bores from said first set of radial bores are alternately spaced adjacent to rows of bores from said second set of radial bores. Each of the bores in a row is aligned at an angle with respect to the axis of the turbine, and such angle can be different from the angle of the bores in the adjacent row with respect to the axis of the turbine engine so that fluid is introduced from a row of bores into the combustor chamber in a plane which intersects the plane of fluid flow from the adjacent row at a point in the interior of the combustor chamber. By providing a plurality of said adjacent rows, a plurality of mixture points are provided throughout the volume of the combustor chamber.

A stationary fuel manifold is spaced radially inwardly from the rotating slinger and is provided with passages which fluidly communicate with said first set of radial bores in said slinger injector. An additional channel is provided in the manifold to direct air from the outlet of the compressor of the turbine engine into said second set of radial bores in said slinger injector. Alternatively, the manifold can be made of a plurality of tubes having appropriate radial bores which fluidly communicate with said first set of radial bores and said slinger injector. In this case, air can be directed from the outlet compressor of the turbine engine between the tubes of the manifold to fluidly communicate with said second set of radial bores in said slinger injector.

BRIEF DESCRIPTION OF THE DRAWING

The present invention will be more clearly understood by reference to the following drawings wherein like reference characters refer to like parts within the several views and wherein:

FIG. 1 is a sectional view of a turbine engine utilizing the slinger injector of the present invention;

FIG. 2 is a fragmentary sectional view of the slinger of the present invention taken substantially along the lines 2—2 of FIG. 1;

FIG. 3 is a fragmentary sectional view of the slinger taken along the lines 3—3 of FIG.

FIG. 4 is a fragmentary sectional view similar to FIG. 1 showing a modification thereof; and FIG. 5 is a sectional view of the device shown in FIG. 4 taken substantially along lines 5—5 of FIG. 4.

DETAILED DESCRIPTION OF THE INVENTION

Referring now to FIG. 1, the turbine engine 10 of the present invention is thereshown comprising a housing 12 and a shaft 14 rotatably mounted therein. A compressor rotor 16 and at least one turbine rotor 18 are secured to the shaft 14 for rotation therewith and are spaced axially apart from each other. Intermediate the rotors 16 and 18 a combustor housing 20 is secured within the housing 12. The combustor housing is provided with a plurality of ports so that air pumped by the compressor rotor 16 can be directed through the compressor diffuser 22 through the ports and into the chamber 24 of the combustor housing. Fluid within the chamber 24 is then expelled through a turbine nozzle 26 to impinge upon the turbine rotor 18. A slinger type injector 28 is coaxially secured to the shaft 14 at one end so that it is spaced radially outward from a fuel manifold 30 and communicates with the chamber 24. As the slinger injector rotates it centrifugally forces fuel from the manifold and air from the compressor diffuser 22 into the chamber 24 in a manner to be described hereinafter.

The combustor housing 20 comprises a swivel plate 32 on one side near its radial inner end. The swivel plate 32 is provided with a plurality of ports 33 which provide fluid communication between the compressor diffuser 22 and the chamber 24. Opposite the swivel plate is an inner combustor wall 34 which is also provided with ports 35 through which air from the compressor diffuser 22 can be directed by appropriate passages into the chamber 24. The area of the chamber 24 between the swivel plate 32 and inner combustor wall 34 defines a conventional primary zone in which fuel and air are mixed. The fuel injector is disposed at the inner radial end of chamber 24 between the swivel plate 32 and the inner combustor wall 34.

The present invention provides additional means for introducing air into the primary zone by providing at least one channel through the fuel manifold which communicates at one end with the air forced from the compressor diffuser 22 and at its other end with an appropriate port in the slinger injector 28. Thus as the slinger injector 28 rotates, it not only forces fuel from the manifold to the primary zone, but in addition, provides an additional flow of air into the primary zone.

As shown in FIG. 1 a single row of radially disposed bores 40 provided in the slinger injector act as air ports so that a radially extending plane of air flow is provided within the combustion chamber 24. On each side of the row of bores or ports 40 is a row of fuel ports 42 and 44, respectively. The ports 42 and 44 are aligned at an angle with respect to the axis normal to the axis of shaft 14 so that fuel expelled from the fuel ports 42 and 44 is introduced in the combustor chamber 24 in a plane which intersects the plane of air flow from the ports 40 at a point within the combustor chamber 24. Additional rows of ports 46 and 48 are provided near the axial ends of the slinger 28 and the ports 46 and 48 are angled with respect to the normal so as to provide a flow of fuel in a plane which intersects the air provided by the ports in the swivel plate 32 and the ports provided in the inner combustor wall 34, respectively, at predetermined points within the combustor chamber 24. Appropriate ports 52, 54, 56, and 58 are provided in the fuel manifold 30 at an appropriate corresponding angle so as to directly fluidly communicate with the fuel ports 42, 44, 46, and 48 of the fuel slinger injector 28.

Although the slinger injector 28 shown in FIG. 1 has been described in detail, it is to be understood that the invention is not so limited and that a plurality of rows of air ports provided at various angles with respect to the normal can be disposed intermediate the rows of fuel ports also provided at various angles with respect to the normal so as to provide a large number of mixing points throughout the volume of the chamber 24. In order to control the flow rate and distribution of air and fuel into the primary zone, the height 60, the width 62, angle 64 (see FIG. 2), and the angle 66 (see FIG. 3) are provided at a predetermined value.

A further modification of the device is illustrated in FIGS. 4 and 5 and discloses a distribution device wherein the manifold comprises a plurality of tubes 70, each tube having appropriate ports 52', 54', 56', and 58' which provide direct fluid communication to the ports 42, 44, 46, and 48 in the fuel slinger 28. Thus air can be supplied to the row of ports 40 as well as additional air ports (not shown) in the slinger 28 by appropriate channels 59 which direct air from the compressor diffuser 22 between the tubes 70 of the manifold.

Thus, the invention provides a means for obtaining a larger zone of fuel and air mixing by providing multiple axial planes or zones of fuel and air introduction to the combustor chamber in a manner which previously has not been effectively applied to slinger type combustors. As the slinger is rotated, fuel and air are centrifugally forced into the combustion chamber as directed by the alignment of the appropriate ports. Thus, each row of ports provides a plane of fluid flow adapted to intersect the plane of fluid flow of an adjacent row or the combustor wall ports at a predetermined point. The invention provides a more even distribution of fuel and air throughout the volume of the combustor chamber and thus increases the heat release rate or combustion intensity for a given combustor chamber volume.

Having thus described my invention many modifications thereto will become apparent to those skilled in the art to which it pertains without departing from the scope and spirit of the invention as defined in the appended claims.

What is claimed is:

1. A turbine engine having a support housing, a shaft rotatably secured within said support housing, an air compressor rotatably mounted in said housing and having an inlet and an outlet, a combustor in said housing, said combustor having a chamber fluidly connected with the outlet of the compressor, means for supplying fuel to the combustor chamber, said last-mentioned means comprising a slinger type fuel injector secured to said shaft having an annular housing and a plurality of radial bores adapted to provide a plurality of axially spaced planes of fuel and air introduction into said combustor chamber, a stationary fuel manifold spaced radially inwardly from said injector housing and in fluid communication with a first portion of said radial bores, and air passage means for fluidly connecting the outlet of the compressor to a second portion of said radial bores.

2. The invention as defined in claim 1 wherein said fuel manifold comprises an annular housing having a plurality of radial bores, each said bore aligned to fluidly communicate with a radial bore in said injector.

3. The invention as defined in claim 1 wherein said fuel manifold comprises a plurality of axially aligned tubes, each tube having at least one radial bore aligned to fluidly communicate with at least one radial bore in said injector.

4. The invention as defined in claim 1 wherein each radial bore in said injector is angled with respect to a radius of said annular injector housing.

5. The invention as defined in claim 1 wherein each radial bore in said injector is angled with respect to the axis of said annular injector housing.

6. The invention as defined in claim 1 wherein the radial bores in said annular injector housing are arranged in axially spaced rows extending around the circumference of said injector housing and wherein alternate rows comprise said first portion of said radial bores.

* * * * *

UNITED STATES PATENT AND TRADEMARK OFFICE

CERTIFICATE OF CORRECTION

PATENT NO. : 4,232,526

DATED : November 11, 1980

INVENTOR(S) : Dennis E. Barbeau

It is certified that error appears in the above-identified patent and that said Letters Patent are hereby corrected as shown below:

Column 2, line 42, after "FIG." insert --2;--.

Signed and Sealed this

*Seventeenth* Day of *February 1981*

[SEAL]

*Attest:*

RENE D. TEGTMEYER

*Attesting Officer*

*Acting Commissioner of Patents and Trademarks*